US007575489B2

(12) United States Patent
Abe et al.

(10) Patent No.: US 7,575,489 B2
(45) Date of Patent: Aug. 18, 2009

(54) SMALL WATERCRAFT CAPABLE OF SUPPRESSING VIBRATION AND NOISE OF THE VESSEL BODY

(75) Inventors: Shintaro Abe, Saitama (JP); Tsuyoshi Kumasaka, Saitama (JP); Toshinori Hanai, Saitama (JP); Hiroshi Iwakami, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/889,973

(22) Filed: Aug. 17, 2007

(65) Prior Publication Data

US 2008/0050992 A1 Feb. 28, 2008

(30) Foreign Application Priority Data

Aug. 25, 2006 (JP) ..... 2006-229223

(51) Int. Cl.
*B63H 11/00* (2006.01)

(52) U.S. Cl. ..... 440/52; 440/38

(58) Field of Classification Search ..... 248/636, 248/638; 440/38, 52; 188/378–380; 267/140.4
See application file for complete search history.

(56) References Cited

U.S. PATENT DOCUMENTS 6,383,040 B2 * 5/2002 Ito et al. ..... 440/38
2005/0132945 A1 * 6/2005 Yamada et al. ..... 114/55.5

FOREIGN PATENT DOCUMENTS

JP 2004-98973 A 4/2004

* cited by examiner

*Primary Examiner*—Ed Swinehart
(74) *Attorney, Agent, or Firm*—Birch, Stewart, Kolasch & Birch, LL

(57) ABSTRACT

To provide a small watercraft capable of suppressing vibration and noise of a vessel body, a jet pump is mounted to a hull via a thrust plate. A dynamic damper is disposed as an adjunct at a plate mounting portion that attaches the thrust plate to the hull. More specifically, the thrust plate is first mounted to the hull. Then, with a flange portion of the jet pump pressed up against a rear surface of the thrust plate, a second bolt is screwed in toward the thrust plate from an outward side of the hull. The jet pump is thereby attached to the rear surface of the thrust plate.

16 Claims, 6 Drawing Sheets

SMALL WATERCRAFT CAPABLE OF SUPPRESSING VIBRATION AND NOISE OF THE VESSEL BODY

CROSS-REFERENCE TO RELATED APPLICATIONS

This nonprovisional application claims priority under 35 U.S.C. § 119(a) on Patent Application No. 2006-229223, filed in Japan on Aug. 25, 2006, the entirety of which is incorporated herein by reference.

BACKGROUND OF THE INVENTION

1. Field of the Invention

The present invention relates to a small watercraft including a jet pump disposed at a rear portion of a hull constituting a lower portion of the watercraft.

2. Background of the Invention

A known small watercraft includes a jet pump disposed at a rear portion of a hull that constitutes a lower portion of the watercraft. Water is expelled rearwardly from a trailing end of the jet pump to let the watercraft plane (see, for example, FIG. 2 of Japanese Patent Laid-Open No. 2004-98973).

Referring to FIG. 2 of Japanese Patent Laid-Open No. 2004-98973, a small surface boat 10 includes a vessel body 11 (the same reference numeral as that of Japanese Patent Laid-Open No. 2004-98973 have been used herein) and a water jet propeller 17 (hereinafter referred to as "jet pump 17"). The vessel body 11 includes an intake port 29 disposed at a hull bottom 28. The jet pump 17 is disposed at a rear portion of a hull that constitutes a lower portion of the vessel body 11. The intake port 29 is extended up to the jet pump 17. The jet pump 17 is rotated, so that water taken in is expelled rearwardly from the intake port 29.

Rotating an impeller 32 of the jet pump 17 under water generates a pressure difference in areas between a front side and a backside of the impeller 32. Cavitation can then occur in low-pressure regions having a low pressure. The cavitation causes the pressure in the jet pump 17 to fluctuate, resulting in the jet pump 17 vibrating. The vibration is transmitted to the vessel body 11 via a wall portion 30 of a jet pump chamber 16. The vessel body 11 is then vibrated and comfort during planing is impaired.

SUMMARY OF THE INVENTION

It is an object of the present invention to provide a small watercraft capable of suppressing vibration and noise of the vessel body.

To achieve the foregoing object, a first aspect of the present invention provides a small watercraft that includes a recess and a jet pump. Specifically, the recess is disposed at a rear portion of a hull that constitutes a lower portion of the watercraft. The jet pump is accommodated in the recess. In this watercraft, a dynamic damper is disposed as an adjunct at a pump mounting portion that attaches the jet pump to the hull.

In accordance with a second aspect of the present invention, the jet pump is mounted to the hull via a thrust plate. Further, the dynamic damper is disposed at a plate mounting portion that, of the pump mounting portion, attaches the thrust plate to the hull.

In accordance with a third aspect of the present invention, the dynamic damper is jointly fastened with a bolt that attaches the jet pump to the hull.

In accordance with a fourth aspect of the present invention, the dynamic damper is disposed on an inside of the hull.

In accordance with the first aspect of the present invention, the dynamic damper is disposed as an adjunct at the pump mounting portion. Vibration of the jet pump is therefore transmitted to the pump mounting portion and the vibration transmitted to the pump mounting portion is absorbed by the dynamic damper disposed as an adjunct at the pump mounting portion. As a result, the dynamic damper absorbs vibration of the jet pump. This reduces vibration transmitted to the hull, thereby suppressing vibration and noise of a vessel body. The reduction in vibration and noise of the vessel body results in enhanced comfort during planing.

In accordance with the second aspect of the present invention, the dynamic damper is disposed as an adjunct at the plate mounting portion that attaches the thrust plate to the hull. Accordingly, vibration of the jet pump is transmitted to the plate mounting portion and can thereby be absorbed by the dynamic damper disposed as an adjunct at the plate mounting portion.

In accordance with the third aspect of the present invention, the dynamic damper is jointly fastened with the bolt that attaches the jet pump to the hull. This eliminates the need for a dedicated bolt for attaching the dynamic damper, circumventing an increase in the number of parts used.

In accordance with the fourth aspect of the present invention, the dynamic damper is disposed on the inside of the hull. Vibration of the jet pump that would otherwise be transmitted to the inside of the hull can therefore be effectively suppressed. In addition, the dynamic damper is not likely to be affected by water.

For example, if the dynamic damper is disposed on an outside of the hull, there is a possibility that the dynamic damper will be entangled in seaweed or other foreign object in water. In this respect, according to the fourth aspect of the present invention, the problem of the dynamic damper's being entangled in seaweed or other foreign object can be eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
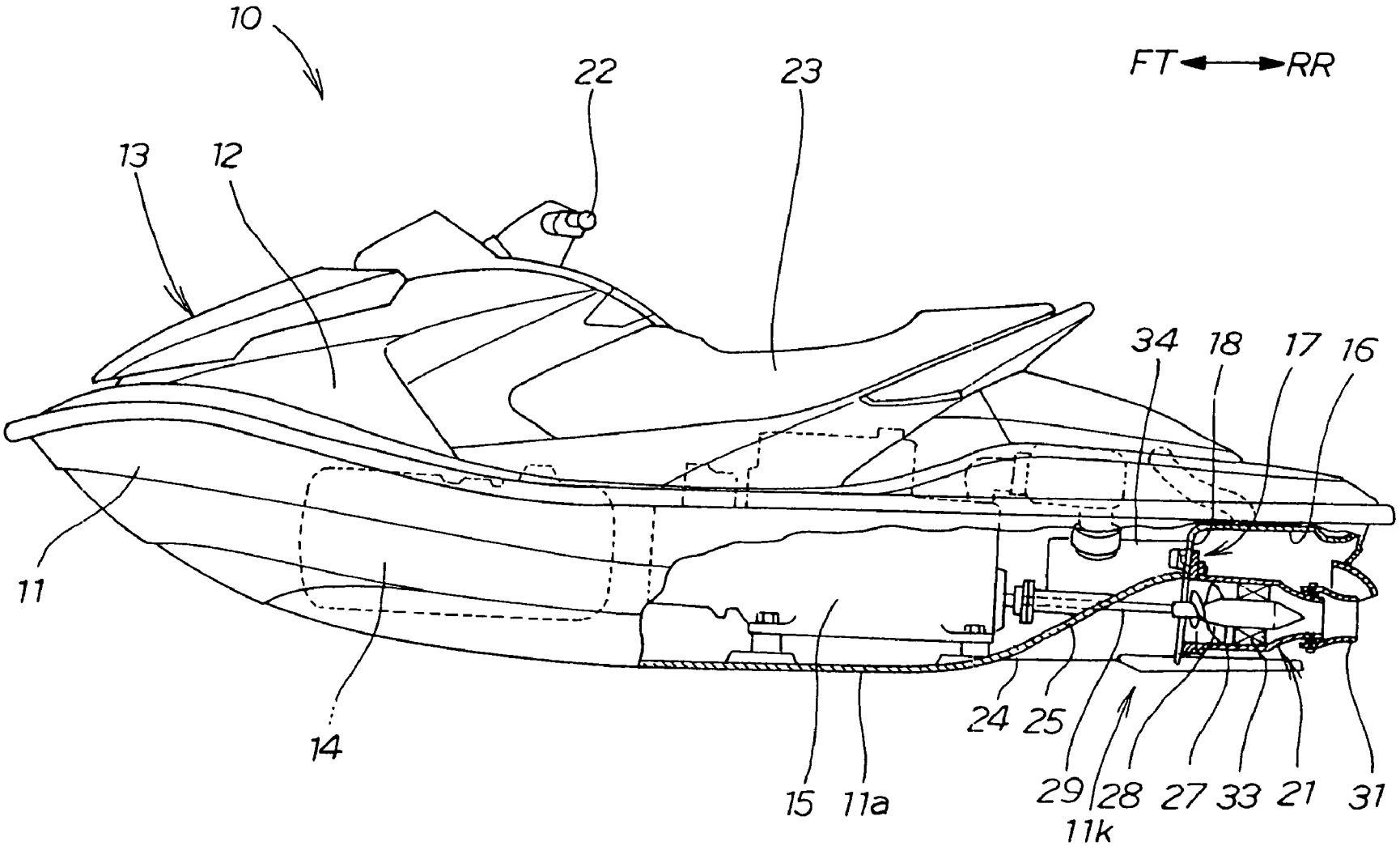
FIG. 1 is a side elevational view showing a small watercraft according to an embodiment of the present invention.

The present invention will now be described in detail with reference to the accompanying drawings, wherein the same reference numerals will be used to identify the same or similar elements throughout the several views. Also, the drawings should be viewed according to the orientation of the reference numerals.

FIG. 1 is a side elevational view showing a small watercraft according to an embodiment of the present invention. A small watercraft 10 includes a vessel body 13, a fuel tank 14, an engine 15, a recess 16, a pump mounting portion 17, a jet pump 21, a steering handlebar 22, and a straddle seat 23. The vessel body 13 includes a hull 11, which constitutes a lower portion of the watercraft, and a deck 12 mounted on an upper portion of the hull 11. The fuel tank 14 is disposed at a front portion of the vessel body 13. The engine 15 is disposed rearward of the fuel tank 14. The recess 16 is disposed rearward of the engine 15 at a rear portion 11*k* of the hull 11. The pump mounting portion 17 is disposed on a front wall portion 18 of the recess 16. The jet pump 21 is mounted in the pump mounting portion 17. The steering handlebar 22 is disposed upward of the fuel tank 14. The straddle seat 23 is disposed rearward of the steering handlebar 22.

There is an intake opening 24 for taking water in disposed at a rear portion of a hull bottom 11*a*. A water introductory pipe 25 is connected to the intake opening 24. The jet pump 21 is connected to the water introductory pipe 25. It is to be noted that the jet pump 21 is mounted on the front wall portion 18 of the recess 16.

The jet pump 21 includes a stator 27, an impeller 28, and a shaft member 29. The stator 27 is of a tubular form. The impeller 28 is rotatably mounted in the stator 27. The shaft member 29 transmits a driving force of the engine 15 to the impeller 28. A steering nozzle 31 is connected to a rear end portion of the stator 27.

The engine 15 rotates the impeller 28. Water drawn in through the intake opening 24 in the hull bottom 11*a* is introduced to the stator 27 via the water introductory pipe 25. The water is then expelled rearward by the impeller 28.

The steering nozzle 31 is disposed laterally swingably at a trailing end of the stator 27. The steering nozzle 31 allows the vessel body 13 to be steered laterally by an operation of the steering handlebar 22. Laterally steering the steering nozzle 31 allows a direction of a stream of water expelled from the jet pump 21 to be changed, so that a planing direction of the vessel body 13 can be changed.

Referring to FIG. 1, reference numeral 33 denotes a bearing member rotatably supporting the impeller 28 and reference numeral 34 represents a muffler that reduces exhaust noise of the engine 15.

Figure 2:
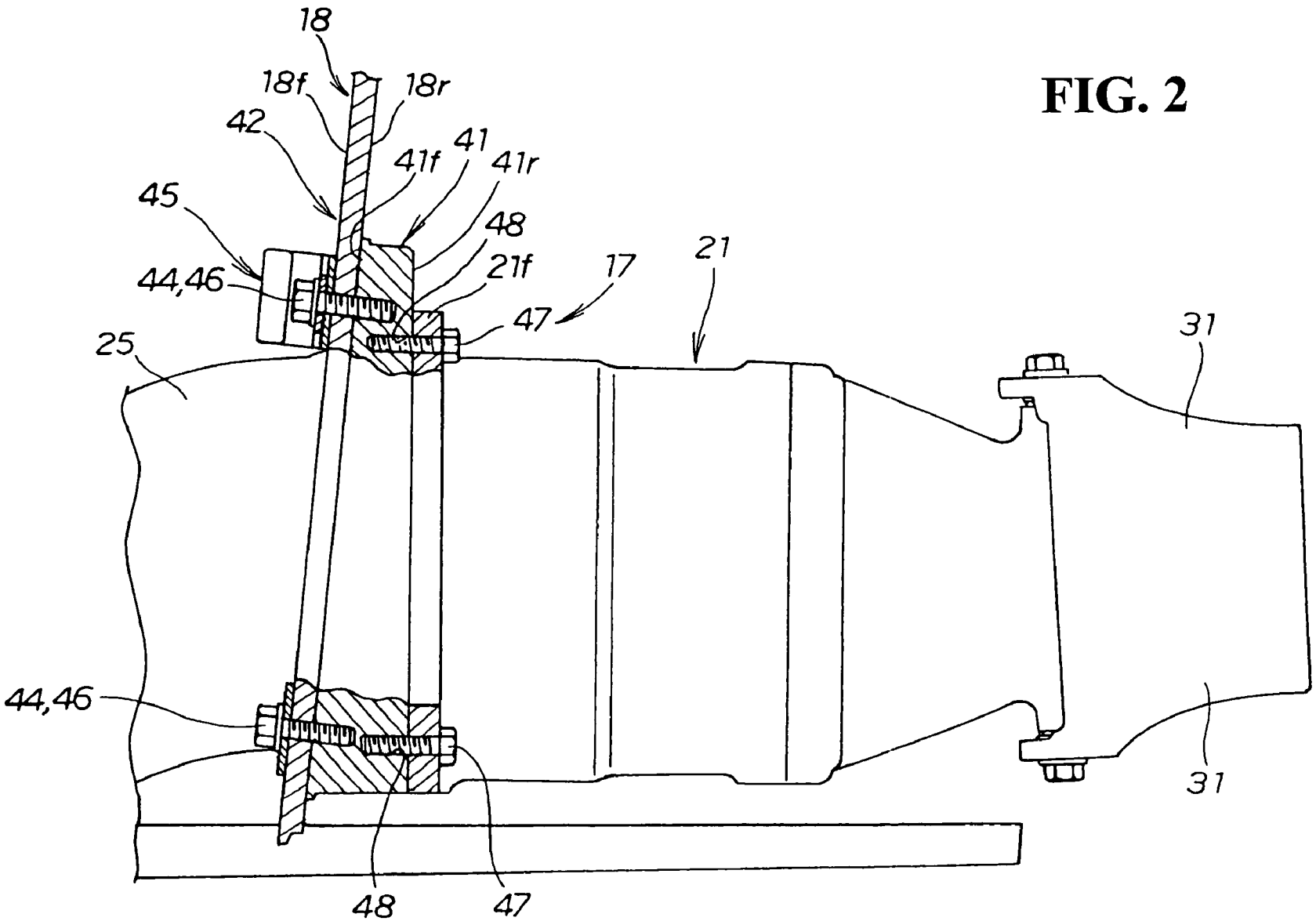
FIG. 2 is a cross-sectional view showing a pump mounting portion according to the embodiment of the present invention.

FIG. 2 is a cross-sectional view showing the pump mounting portion according to the embodiment of the present invention. A front surface 41*f* of a thrust plate 41 is pressed against a plate mounting portion 42 included in the hull 11. First bolts 44, 44 are then screwed in toward the thrust plate 41 from an inward side of the hull 11. The thrust plate 41 is thereby attached to the plate mounting portion 42. The plate mounting portion 42 is the front wall portion 18 in the recess 16 and includes a front surface and a rear surface 18*f*, 18*r* of the front wall portion 18.

A dynamic damper 45, disposed on an inside of the hull (reference numeral 11 of FIG. 1), is jointly fastened with the first bolt 44 that secures an upper portion of the thrust plate 41. The dynamic damper 45 includes a bob (or a weight) and an elastic member formed from a spring, rubber, or the like for supporting the bob.

The dynamic damper 45 included in a vibrating hull resonates to vibrate violently, which dampens vibration in the hull correspondingly. A resonance range of the dynamic damper 45 can be controlled by an adjusting mass (bob or weight) constituting the dynamic damper 45 and the elastic member (spring or rubber) connecting the mass to the hull.

The shape and weight of the dynamic damper 45 are determined in response to vibration characteristics of the hull, so that vibration of the hull can be dampened.

The thrust plate 41 is mounted in the hull 11. Then, a flange portion 21*f* of the jet pump 21 is abutted on a rear surface 41*r* of the thrust plate 41. Second bolts 47, 47 are then screwed in toward the thrust plate 41 from an outward side of the hull 11. The jet pump 21 is thereby attached to the rear surface 41*r* of the thrust plate 41.

Specifically, the jet pump 21 is mounted to the hull 11 via the thrust plate 41 and the dynamic damper 45 is attached to the plate mounting portion 42 that attaches the thrust plate 41 to the hull 11.

Since the dynamic damper 45 is attached as an adjunct to the plate mounting portion 42, vibration of the jet pump 21 can be effectively absorbed. The thrust plate 41 mounted to the hull 11 includes jet pump fixing holes 48, 48 made therein. The second bolts 47, 47 as a fastening member are screwed in these jet pump fixing holes 48, 48, so that the jet pump 21 is secured in position. This allows the jet pump 21 to be removed or reinstalled easily from an outside of the hull 11. The easy removal or reinstallation of the jet pump 21 enhances maintainability of the jet pump 21.

It is to be noted that the pump mounting portion 17 for mounting the jet pump 21 to the hull 11 is to include the plate mounting portion 42 for mounting the thrust plate 41 to the hull 11.

In accordance with the embodiment of the present invention, the dynamic damper 45 is fastened with the first bolt 44 that secures the upper portion of the thrust plate 41. The dynamic damper 45 may still be fastened with the second bolt 47 that secures the flange portion 21*f* of the jet pump 21.

Figure 3:
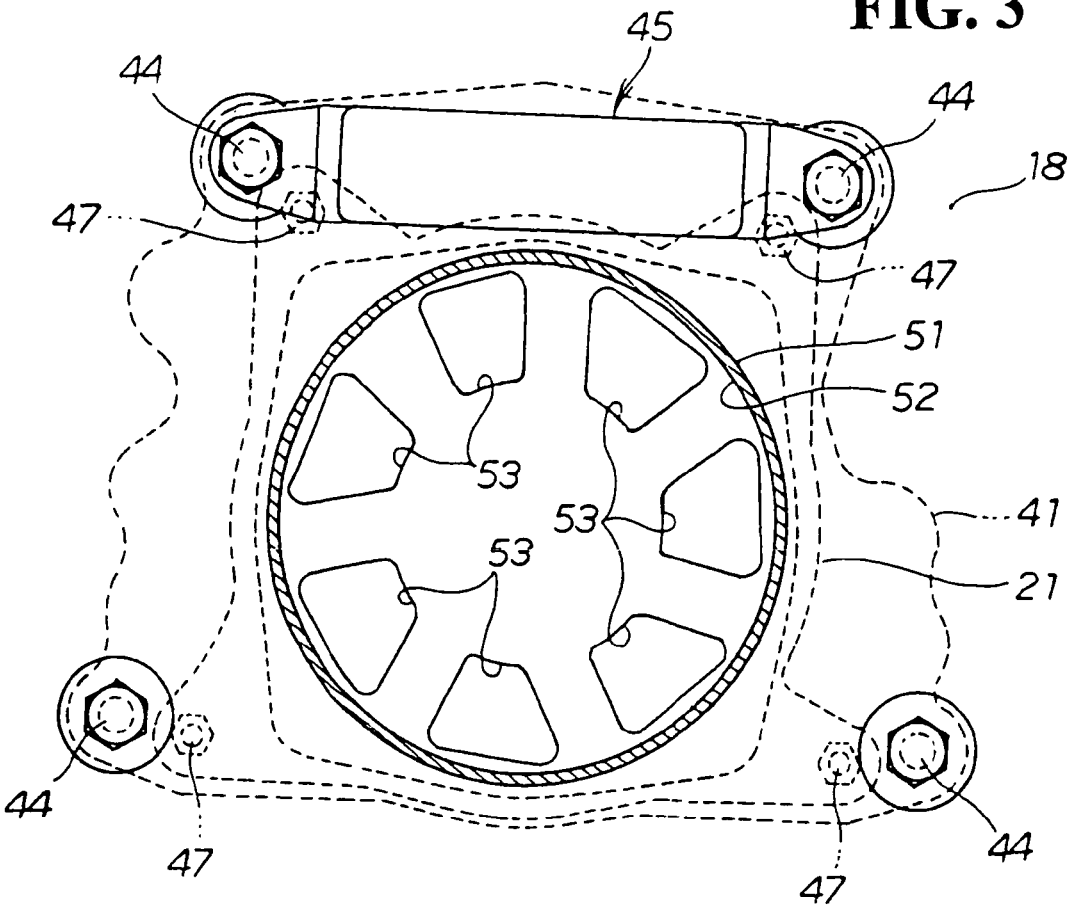
FIG. 3 is a view for illustrating that a dynamic damper is attached as an adjunct to the pump mounting portion.

FIG. 3 is a view for illustrating that the dynamic damper is attached as an adjunct to the pump mounting portion, looking at the front wall portion 18 of the recess (reference numeral 16 in FIG. 1) disposed in the rear portion of the hull from an inward side of the hull (reference numeral 11 in FIG. 1) outwardly. FIG. 3 shows that an introductory pipe 51 is connected to an opening 52 in the front wall portion 18. The thrust plate 41 is mounted from the backside of FIG. 3 to the front wall portion 18 around the opening 52. The jet pump 21 is attached to the thrust plate 41. In FIG. 3, reference numerals 53 identify water discharge ports at a trailing end portion of the jet pump 21. The impeller and the shaft member are omitted in FIG. 3.

Means for securing the thrust plate 41 to the front wall portion 18 are a total of the four upper and lower first bolts. The first bolts 44 are screwed into position from the front side to backside of FIG. 3. Means for securing the jet pump 21 to the thrust plate 41 are a total of the four upper and lower second bolts 47, which are screwed into position from the backside to front side of FIG. 3.

As described earlier, the dynamic damper 45 is disposed on the inside of the hull (reference numeral 11 of FIG. 1) and jointly fastened with the first bolts 44 that secure the upper portion of the thrust plate 41.

Since the dynamic damper 45 is disposed on the inside of the hull 11, vibration of the jet pump 21 transmitted to the inside of the watercraft can be effectively suppressed. Additionally, the dynamic damper 45 is not affected by water. For example, there is no chance that the dynamic damper 45 will be entangled in seaweed or other foreign object in water.

Figure 4:
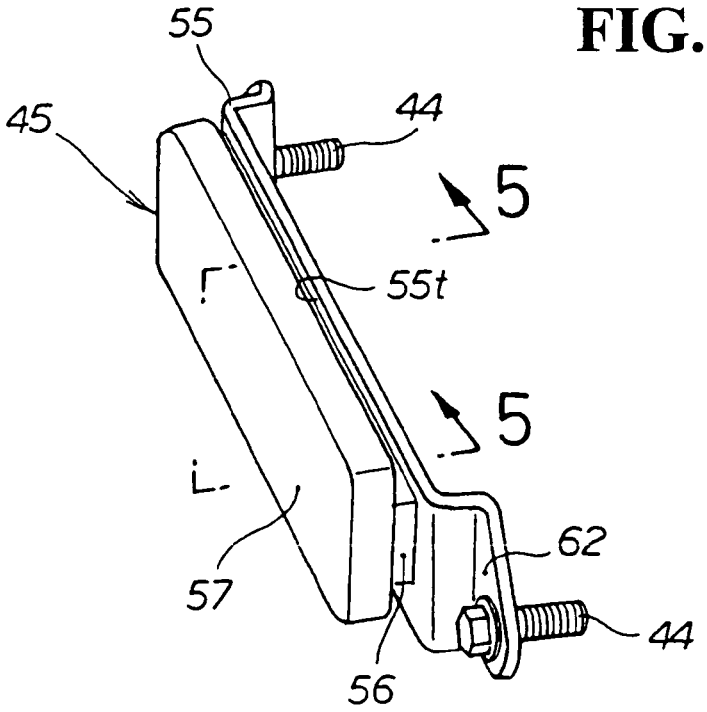
FIG. 4 is a perspective view showing a dynamic damper according to a first embodiment of the present invention.
Figure 5:
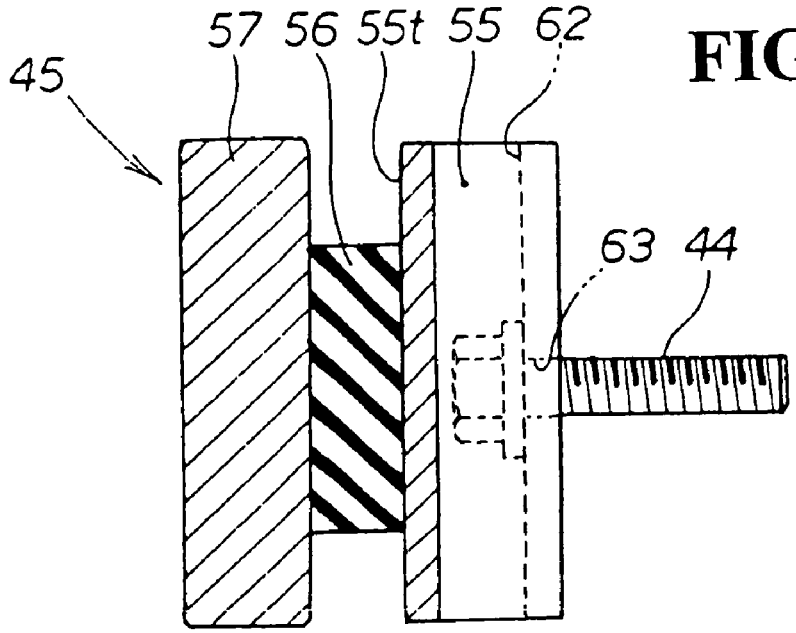
FIG. 5 is a cross-sectional view showing a principal part the dynamic damper shown in FIG. 4.

FIG. 4 is a perspective view showing the dynamic damper according to a first embodiment of the present invention. FIG. 5 is a cross-sectional view showing a principal part of the dynamic damper shown in FIG. 4. The dynamic damper 45 will be described below with reference to FIGS. 4 and 5.

The dynamic damper 45 includes a stay 55, a rubber 56, and a weight 57. The rubber 56 is disposed on an upper surface 55*t* of the stay 55. The weight 57 is disposed on an upper surface of the rubber 56. The rubber 56 has the upper surface bonded to the weight 57 through baking and a lower surface bonded to the upper surface 55*t* of the stay 55 through baking. Bonding together the weight 57, the rubber 56, and the stay 55 through baking eliminates any protrusions of fastening members, allowing the dynamic damper 45 to be configured compactly.

The stay 55 includes the upper surface 55*t*, to which the rubber 56 is fixed, and flanges 62 on the left and right sides thereof serving as mounting seats. The flanges 62 include mounting holes 63, 63 (reference numeral 63 on one side only is shown), through which the first bolts 44, 44 for mounting the dynamic damper 45 to the hull 11 are passed.

Effects of the small watercraft having the dynamic damper will be described below.

Referring back to FIG. 2, the dynamic damper 45 is attached as an adjunct to the pump mounting portion 17. This allows the dynamic damper 45 to absorb vibration of the jet pump 21. Since the vibration of the jet pump 21 is suppressed, vibration of the hull 11 is suppressed, which allows vibration and noise of the vessel body 13 including the hull 11 to be reduced. The reduction in vibration and noise of the vessel body 13 results in enhanced comfort during planing.

Figure 6:
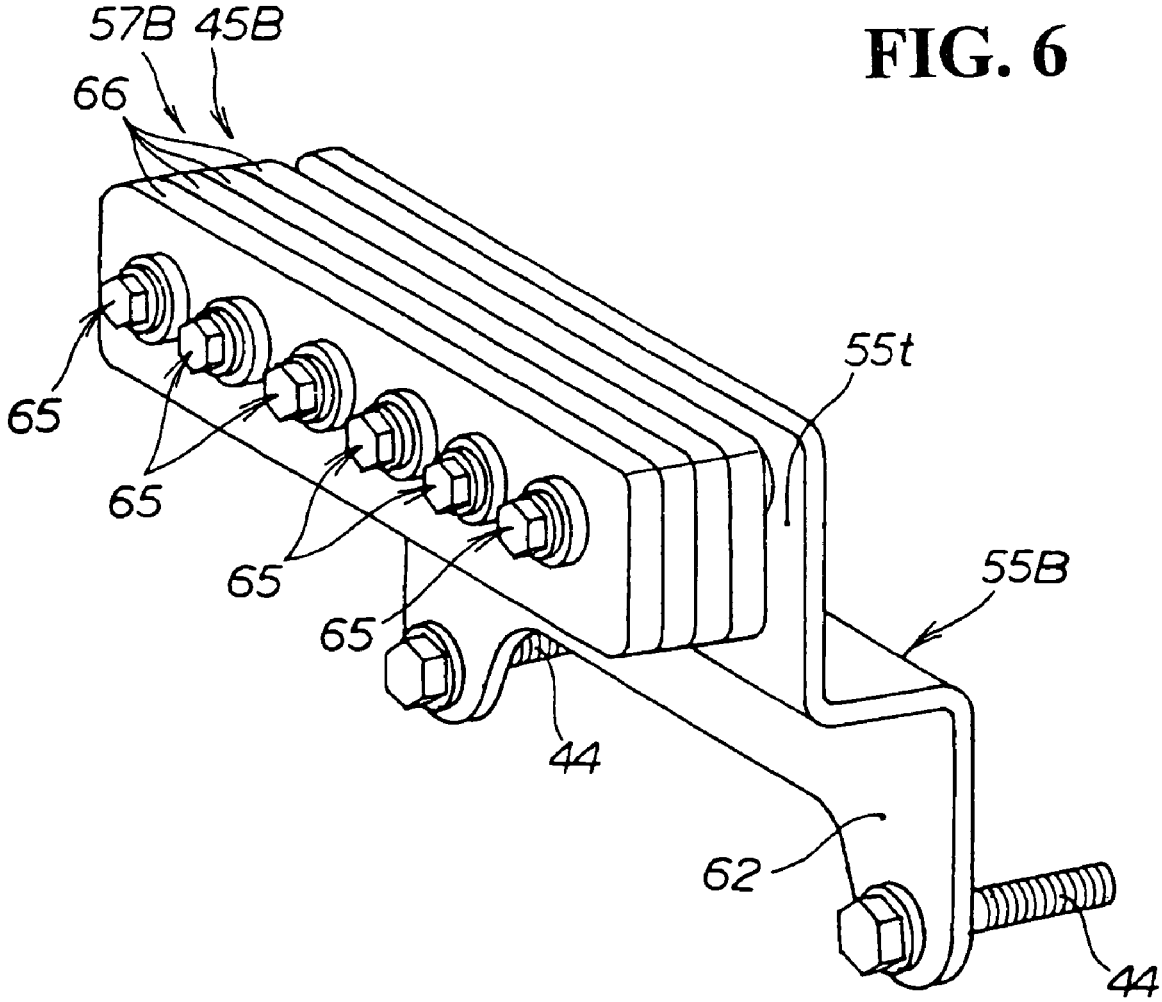
FIG. 6 is a perspective view showing a dynamic damper according to a second embodiment of the present invention.
Figure 7:
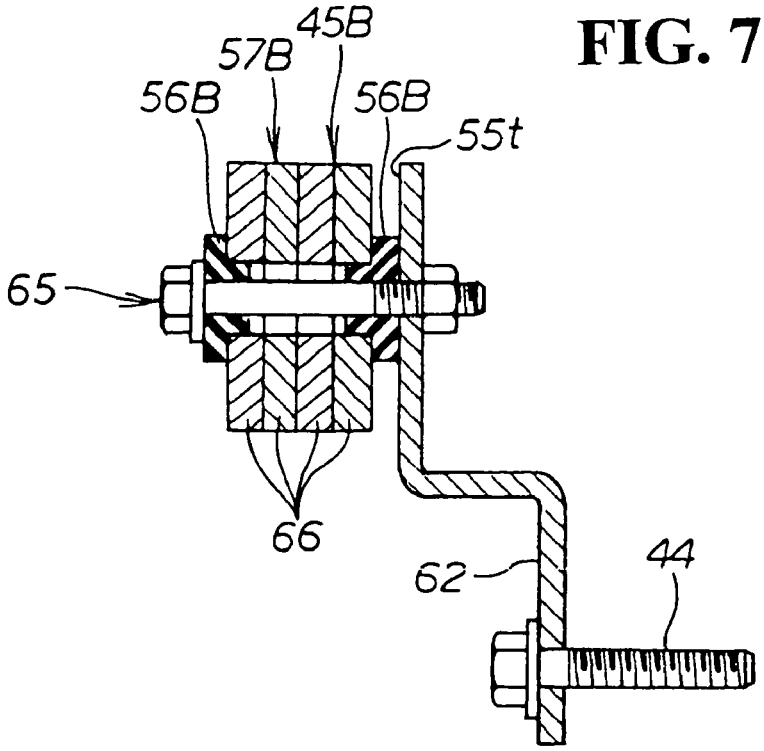
FIG. 7 is a cross-sectional view showing a principal part of the dynamic damper shown in FIG. 6.

FIG. 6 is a perspective view showing a dynamic damper according to a second embodiment of the present invention. FIG. 7 is a cross-sectional view showing a principal part of the dynamic damper shown in FIG. 6. The dynamic damper will be described below with reference to FIGS. 6 and 7.

A dynamic damper 45B includes a stay 55B and a weight 57B. The weight 57B is mounted to the stay 55B via flanged rubbers 56B, 56B and fasteners 65.

The dynamic damper 45 according to the first embodiment of the present invention differs from the dynamic damper 45B according to the second embodiment of the present invention in the following points. Specifically, the weight 57B includes a plurality of sheets 66 stacked one on top of another. The weight 57B is mounted to the stay 55B using the fasteners 65. Further, flanges 62, which serve as mounting seats for the stay 55B, are disposed on both sides downward of an upper surface, to which the rubbers 56B, 56B are secured. The dynamic damper 45B, having arrangements as described above, allows the number of sheets 66 to be varied. More specifically, a resonance point of the vessel body (reference numeral 13 in FIG. 1) can be achieved by adjusting the mass of the weight 57B and vibration of the vessel body can thereby be effective suppressed.

The flanges 62 of the stay 55B are disposed on both sides downward of the upper surface, to which the rubber 56B is secured. Should a bolt 46 overlap an introductory pipe 51 in a side view, use of the stay 55B allows the dynamic damper 45B to be mounted, while avoiding interference with the introductory pipe 51.

Figure 8:
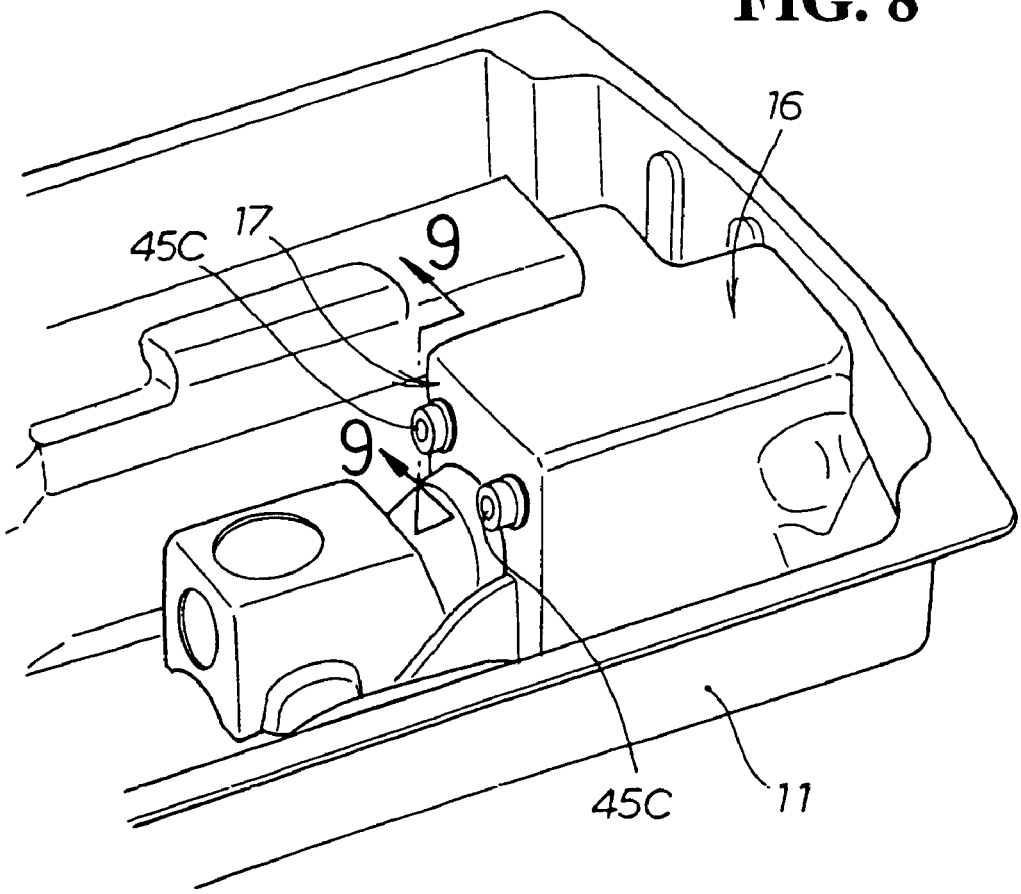
FIG. 8 is a perspective view showing a dynamic damper according to a third embodiment of the present invention mounted to a pump mounting portion.

FIG. 8 is a perspective view showing a dynamic damper according to a third embodiment of the present invention mounted to a pump mounting portion. Dynamic dampers 45C, 45C are attached as an adjunct to a pump mounting portion 17, to which a jet pump (reference numeral 21 of FIG. 1) is mounted.

Figure 9:
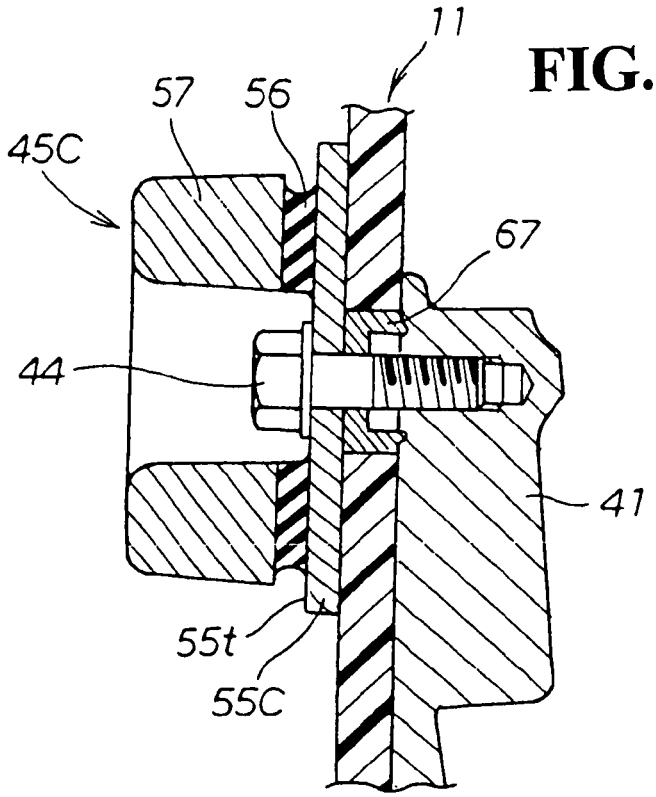
FIG. 9 is a cross-sectional view taken along line 9-9 of FIG. 8.

FIG. 9 is a cross-sectional view taken along line 9-9 of FIG. 8. A thrust plate 41 supporting the jet pump (reference numeral 21 of FIG. 1) is pressed up against a hull 11. A first bolt 44 is then screwed in toward the thrust plate 41 from an inward side of the hull 11, so that the thrust plate 41 is fastened to the hull 11.

The dynamic damper 45C is disposed on an inside of the hull 11, fastened jointly with a first bolt 44 fixing an upper portion of the thrust plate 41. In FIG. 9, reference numeral 67 represents a reinforcement embedded in the hull 11 for reinforcing the pump mounting portion 17.

The dynamic damper 45C includes a stay 55C, a rubber 56, and a weight 57. The rubber 56 is disposed on an upper surface 55*t* of the stay 55C. The weight 57 is disposed on an upper surface of the rubber 56. The rubber 56 has the upper surface bonded to the weight 57 through baking and a lower surface bonded to the stay 55 through baking.

The weight 57 is disposed in an axial direction of, and concentric with, the first bolt 44. Additionally, the first bolt 44 extends axially substantially the same as the jet pump 21 does. Accordingly, the weight 57 effectively acts relative to an axial vibration of the jet pump 21. Specifically, axial vibration of the jet pump 21 can be absorbed.

Figure 10:
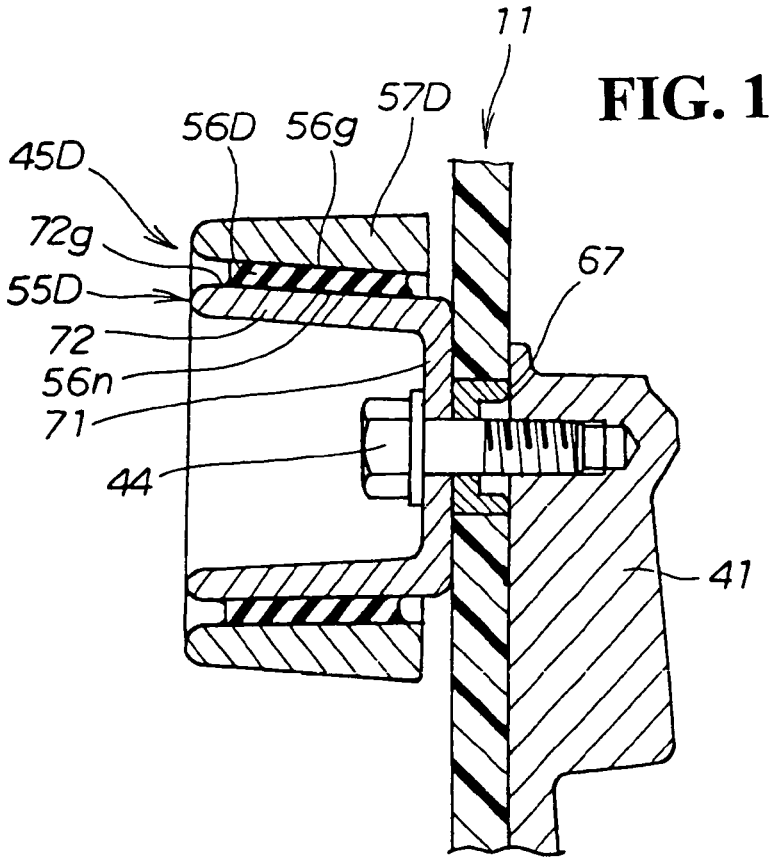
FIG. 10 is a cross-sectional view showing a dynamic damper according to a fourth embodiment of the present invention.

FIG. 10 is a cross-sectional view showing a dynamic damper according to a fourth embodiment of the present invention. A thrust plate 41 is fastened to the dynamic damper by screwing a first bolt 44 in the thrust plate 41 from an inward side of a hull 11.

A dynamic damper 45D includes a stay 55D, a rubber 56D, and a weight 57D. The stay 55D includes a flange 71 and a tube 72 formed in the flange 71 into a tubular shape. The rubber 56D is disposed on an outer peripheral surface 72*g* of the tube 72 of the stay 55D. The weight 57D is disposed on an outer peripheral surface 56*g* of the rubber 56D. The rubber 56D has the outer peripheral surface bonded to the weight 57D through baking and an inner peripheral surface 56*n* bonded to the stay 55D through baking.

The weight 57D is disposed substantially at right angles with an axial direction of, and concentric with, the first bolt 44. Additionally, the first bolt 44 extends axially substantially the same as the jet pump 21 does. Accordingly, the weight 57D effectively acts relative to a circumferential vibration of the jet pump 21. Specifically, circumferential vibration of the jet pump 21 can be absorbed.

It is to be herein noted that, in accordance with the first aspect of the present invention, the dynamic damper may be fastened using a dedicated bolt for fixing the dynamic damper, instead of using the bolt that jointly fastens the jet pump to the hull. The dynamic damper may also be disposed on the outside of the hull.

The present invention is favorably applicable to a small watercraft having a jet pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A watercraft, comprising:

a recess disposed at a rear portion of a hull constituting a lower portion of the watercraft; and a jet pump accommodated in the recess, wherein a dynamic damper is disposed as an adjunct at a pump mounting portion that attaches the jet pump to the hull, the dynamic damper including a stay, a rubber and a weight, the stay being attached to the pump mounting portion, the rubber being disposed on an upper surface of the stay, and the weight being disposed on an upper surface of the rubber, wherein the dynamic damper is mounted to an inside surface of the pump mounting portion by a bolt, and the stay, rubber and weight are concentric with an axis of the bolt.

2. The watercraft according to claim 1, wherein the jet pump is mounted to the hull via a thrust plate, and the dynamic damper is disposed at a plate mounting portion that attaches the thrust plate to the hull.

3. The watercraft according to claim 1, wherein the dynamic damper is jointly fastened with a bolt that attaches the jet pump to the hull.

4. The watercraft according to claim 1, wherein the dynamic damper is disposed on an inside of the hull.

5. The watercraft according to claim 2, wherein the dynamic damper is disposed on an inside of the hull.

6. The watercraft according to claim 3, wherein the dynamic damper is disposed on an inside of the hull.

7. The watercraft according to claim 1, wherein the weight is mounted to the stay via rubbers and fasteners.

8. The watercraft according to claim 1, wherein the dynamic damper is attached to an inside surface of the pump mounting portion of the hull by a first plurality of bolts, a thrust plate is mounted to an outside surface of the pump mounting portion of the hull by said first plurality of bolts, and the jet pump is mounted to the thrust plate by a second plurality of bolts.

9. A jet pump mounting assembly for a watercraft, comprising:

a hull constituting a lower portion of the watercraft;

a recess disposed at a rear portion of the hull;

a jet pump accommodated in the recess and attached to a plate mounting portion of the hull; and a dynamic damper attached to the plate mounting portion, wherein the dynamic damper includes a stay, a rubber and a weight, the stay is attached to the plate mounting portion, the rubber is disposed on an upper surface of the stay, and the weight is disposed on an upper surface of the rubber;

wherein the dynamic damper is mounted to an inside surface of the plate mounting portion by a bolt, and the stay, rubber and weight are concentric with an axis of the bolt.

10. The jet pump mounting assembly for a watercraft according to claim 9, wherein the jet pump is mounted to the plate mounting portion of the hull via a thrust plate.

11. The jet pump mounting assembly for a watercraft according to claim 9, wherein the dynamic damper is jointly fastened with a bolt that attaches the jet pump to the hull.

12. The jet pump mounting assembly for a watercraft according to claim 9, wherein the dynamic damper is disposed on an inside of the hull.

13. The jet pump mounting assembly for a watercraft according to claim 10, wherein the dynamic damper is disposed on an inside of the hull.

14. The jet pump mounting assembly for a watercraft according to claim 11, wherein the dynamic damper is disposed on an inside of the hull.

15. The jet pump mounting assembly for a watercraft according to claim 9, wherein the weight is mounted to the stay via rubbers and fasteners.

16. The jet pump mounting assembly for a watercraft according to claim 9, wherein the dynamic damper is attached to an inside surface of the plate mounting portion of the hull by a first plurality of bolts, a thrust plate is mounted to an outside surface of the plate mounting portion of the hull by said first plurality of bolts, and the jet pump is mounted to the thrust plate by a second plurality of bolts.

* * * * *